US006217023B1

(12) United States Patent
Kremer

(10) Patent No.: US 6,217,023 B1
(45) Date of Patent: Apr. 17, 2001

(54) SPATIAL LOGIC PUZZLE

(75) Inventor: Thomas Kremer, London (GB)

(73) Assignee: Seven Towns Limited, London (GB)

( * ) Notice: Subject to any disclaimer, the term of this patent is extended or adjusted under 35 U.S.C. 154(b) by 0 days.

(21) Appl. No.: 09/300,940

(22) Filed: Apr. 28, 1999

(30) Foreign Application Priority Data

Feb. 19, 1999 (GB) ..... 99 03800
Apr. 13, 1999 (GB) ..... 99 08461

(51) Int. Cl.[7] ..... A63F 9/08
(52) U.S. Cl. ..... 273/153 R; 273/153 S
(58) Field of Search ..... 273/153 S, 157 R, 273/153 R, 156

(56) References Cited

U.S. PATENT DOCUMENTS

| | | | |
|---|---|---|---|
| 4,513,970 | | 4/1985 | Opresco et al. . |
| 4,540,177 | | 9/1985 | Horvath . |
| 4,593,907 | | 6/1986 | Abu-Shumays et al. . |
| 6,027,116 | * | 2/2000 | Patermann . |

FOREIGN PATENT DOCUMENTS

| | | |
|---|---|---|
| 8301203 | 4/1983 | (WO) . |

OTHER PUBLICATIONS

Great Britain Search Report, application No. GB 9908461.8, 5/1999.

* cited by examiner

*Primary Examiner*—William M. Pierce
(74) *Attorney, Agent, or Firm*—Baker Botts L.L.P.

(57) ABSTRACT

A spatial logic or manipulative puzzle in the form of a 2×2×2 cube is provided comprising a body made of interconnected pieces, groups of which are relatively rotatable about three axes to exchange positions of the pieces, wherein exposed faces of the pieces are sculptured to define an image. Each piece has means for establishing a pivotal connection to other pieces of the puzzle, at least three planar faces for slideable abutment with adjoining faces of other pieces, and at least one exposed face which is sculptured to define part of an image. The internal mechanism is preferably controlled by a castellated spider fixed in relationship to one of the pieces. A mechanism of this type enables the pieces and components to be interengaged and secured together by pushing the last piece home and does not require internal screws or springs or gluing as in some other known cube mechanisms.

14 Claims, 7 Drawing Sheets

FIG. 1
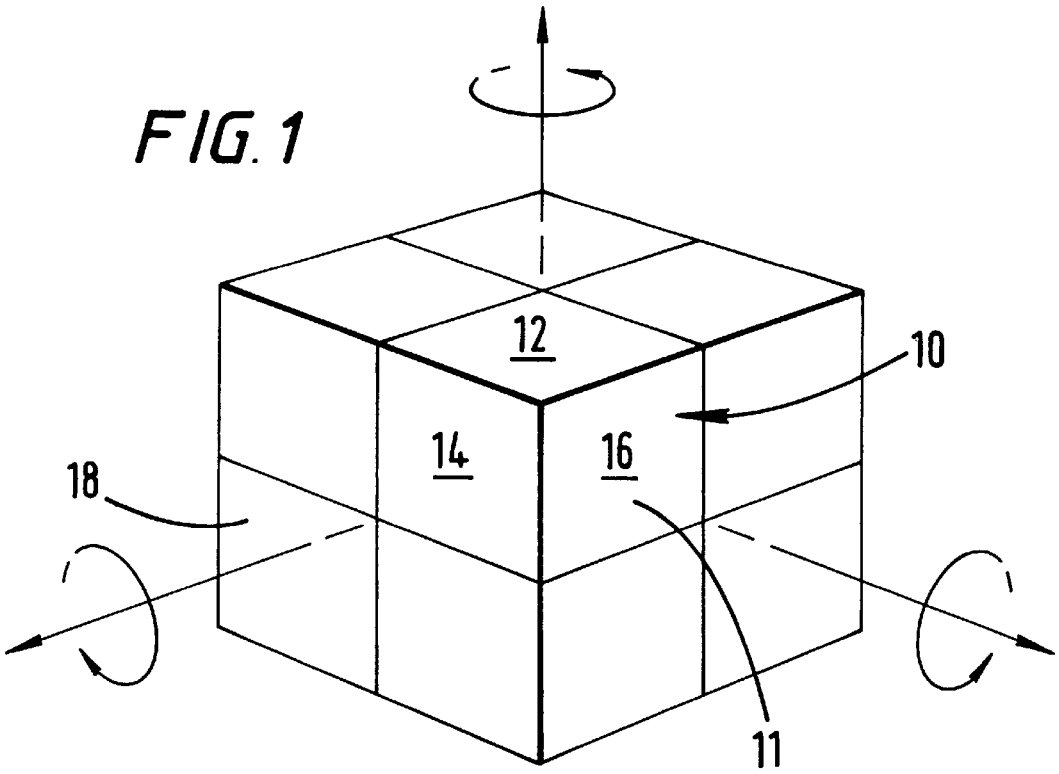
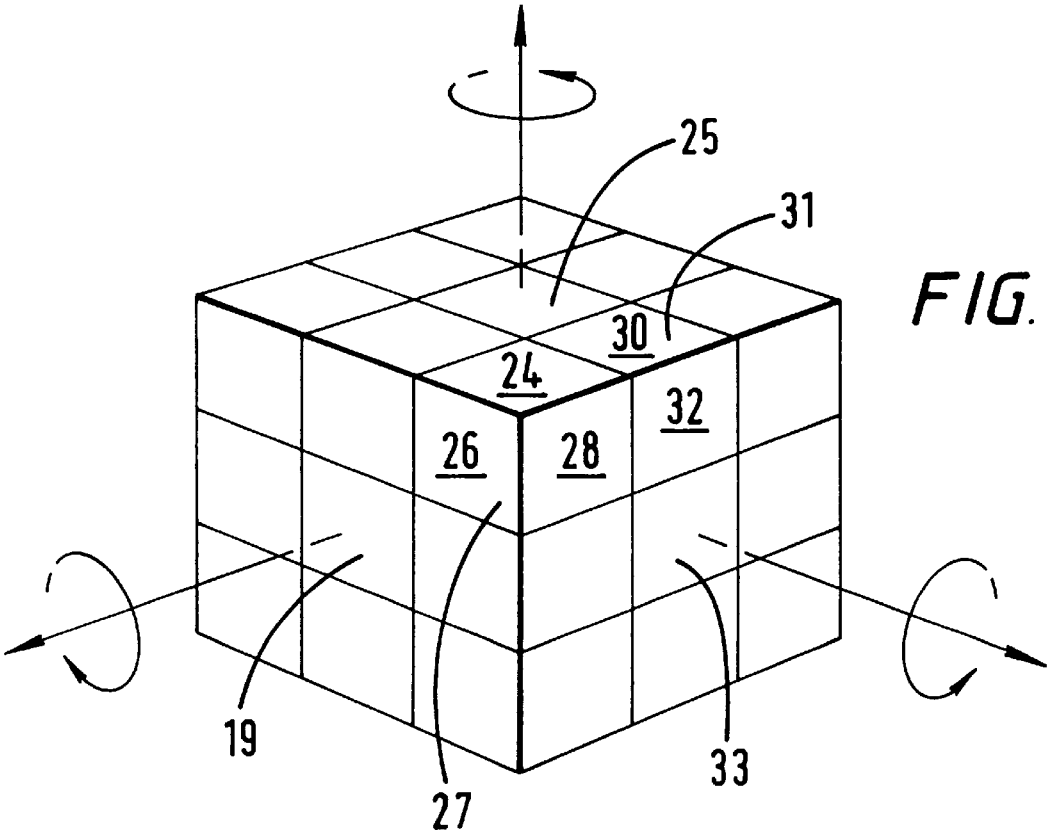
FIG. 2

SPATIAL LOGIC PUZZLE

FIELD OF THE INVENTION

The present invention relates to a spatial logic puzzle which is useful as a plaything and/or to teach spatial awareness and a systematic approach to problem solving and which combines the play or puzzle value of a manipulative puzzle such as a Rubik's cube with that of a jigsaw.

BACKGROUND TO THE INVENTION

Professor Ernö Rubik is the inventor of the well-known Rubik's cube described in HU-B-170062 (1976). It is based on the idea of providing a body made up from one or more sets of equivalent but identifiable pieces which are interconnected so that groups of pieces are relatively rotatable about three orthogonal axes. The pieces can exchange positions while the external shape of the body remains unchanged. Solutions of the puzzle are disclosed in a book by Tom Werneck, "Der Zauber-Würfel", Wilhelm Heyne Verlag, 1981 (ISBN 3453-41449-7), the disclosure of which is incorporated herein by reference. Although the most popular form of the puzzle was a 3×3×3 cube, it was also produced as a 2×2×2 and 4×4×4 cube. A modified version of the cube was also produced in which the pieces were cut-off diagonally to give a puzzle which was octohedral when viewed in plan and in which the external shape of the body could be broken up by moving the pieces. Although Professor Rubik contemplated in his patent alternatives to a closed cube, and mentioned the possibility of the puzzle taking the form of another regular or semi-regular or amorphous body, semi-regular and amorphous bodies were not investigated. Instead, further developments in the field of logical puzzles lead to the Magic Pyramid described by Tom Wernick and to drum-based or sphere-based sliding bead puzzles.

WO 83/01203 (Torres) discloses a three-dimensional geometric puzzle having its pieces in a 3×3×3 arrangement, with the pieces shaped so that the external surface of the puzzle defines, in an undisturbed state of the puzzle, an identifiable three-dimensional object which may be inter alia a human head. The present applicants are not aware of any practical product having resulted from this disclosure, and believe that this lack of success was because the resulting puzzle was too difficult for acceptance by users.

The mechanical structure of a 3×3×3 Rubik's Cube has been described by D. R. Hofstadter in Scientific American, March 1981, pages 20–39 and is based on a central spider providing for rotation about three orthogonal axes, the central cube of each side face being attached to the spider by screws. An alternative internal mechanism for a 3×3×3 cube is disclosed in JP-A-55-3956 (1980). Like that of the original Rubik's cube, it requires internal screws to hold it together and additionally it has ball catches to define the positions where the pieces are accurately in register.

Commercially available 2×2×2 Rubiks cubes have a castellated spider mechanism based on a six-armed spider relative to which one piece is mechanically located in a fixed position and the remaining pieces are movable. Castellated members fit on the arms of the spider and each fit within two of the pieces. Three of the castellated members are rotatable on their respective arms and three of them are fixed. The mechanism has the advantage that the puzzle can be assembled simply by inter-engaging the individual internal parts and pieces and pushing the last piece into place, no screws or springs being required. An alternative internal mechanism for a 2×2×2 cube is shown in JP-A-55-8193 (1980) and has a central ball carrying six concentric part spherical guide members disposed in pairs along the three orthogonal axes and spaced a small distance above the surface of the ball. The attachment of the guide members to the central ball is by screws. Gaps are defined between adjacent pairs of follower plates. The movable pieces each have a part spherical plate which is trapped between the surface of the ball and a pair of the guide plates. The piece is connected to its trapped plate by a single peg which passes through the gap between the side plates. Because the piece is supported from the single peg, thick sections are needed where the piece and the peg join if adequate support and rigidity is to be obtained.

SUMMARY OF THE INVENTION

This invention is based on the realization that by providing a logical puzzle of the aforesaid kind in which some or all of the exposed faces of the relatively movable pieces of a 2×2×2 cube are sculptured and optionally decorated to define portions of a three-dimensional figurative work, e.g. a head or a head and shoulders, it is possible to provide a logical puzzle which combines the amusement value of a manipulative puzzle and of a jigsaw but which is surprisingly challenging and is acceptable to a wide body of users. In a conventional Rubiks cube, the visible faces of the pieces are marked to show the faces of the correctly organised puzzle to which they belong. In the disorganised state of the puzzle, it is immediately apparent which cube faces belong together. In contrast, when a figurative puzzle is in a disorganised state, matching faces which form a face of the completed puzzle are not self-evident and have to be identified by the user, which adds a level of difficulty. Solving the 2×2 puzzle presents a sufficient challenge to many users.

Accordingly, in one aspect, the invention provides a manipulative puzzle comprising a body made of interconnected pieces in a 2×2×2 arrangement, groups of which are relatively rotatable about three axes to exchange positions of the pieces, wherein exposed faces of the pieces are sculptured to define an image.

In a further aspect, the invention provides a manipulative puzzle comprising a body made of interconnected pieces in a 2×2×2 arrangement, groups of which are relatively rotatable about three axes to exchange positions of the pieces, wherein exposed faces of the pieces are sculptured to define an image, and wherein the pieces are held together by interlocking of the internal parts which becomes established by pushing the final piece into place. It is an advantage of puzzles of the above mentioned kind that smooth running can be achieved by a closely toleranced fit between the components rather than by the use of compression springs or the like to maintain the components at the correct tightness.

The invention also provides a manipulative puzzle comprising a body made of interconnected pieces in a 2×2×2 arrangement, groups of which are relatively rotatable about three axes to exchange positions of the pieces, wherein exposed faces of the pieces are sculptured to define an image and wherein the pieces are supported and controlled by a castellated spider mechanism. Again the catsellated spider mechanism has the associated advantage that smooth movement can be achieved by a toleranced fit between the components. Furthermore the external movable parts in a castellated spider mechanism are supported over a relatively large area, giving stable and even support. This allows the pieces to be moulded in thinner sections which speeds up production and gives more reliable results.

The invention further provides a manipulative puzzle comprising a body made of interconnected pieces in a 2×2×2 arrangement and an internal mechanism supporting groups of the pieces for relative rotation about three axes to exchange positions, wherein one of the pieces is fixed in position relative to and physically joined to the internal mechanism. The exposed faces of the pieces may be sculptured to define an image.

In a yet further aspect, the invention provides a piece for the manipulative puzzle having means for establishing a pivotal connection to other pieces of the puzzle, at least three planar faces for slideable abutment with adjoining faces of other pieces, and at least one exposed face which is sculptured to define part of an image. The piece may be a moulding in thermoplastics material and may carry decoration provided by pigmented areas on its outer sculpted face or faces.

DESCRIPTION OF PREFERRED FEATURES

In puzzles of the aforesaid kind, the pieces generally meet at abutting planar faces which slide past one another. In order to improve the appearance and function of the puzzle, it is highly desirable that all the internal sliding faces should be closed with flat panels. The largest dimensions of at least two, and optionally all three of the planar faces of each piece may differ. This difference in face major dimension increases the freedom of the designer concerning the range of works which he can create.

The sculptured faces may be incorporated into the pieces in various ways. In one variant, at least some of the pieces comprises an inner portion connected to the other pieces and an outer portion which is sculptured to define part of the image and is attached to the inner portion. The outer portion may be a push or snap fit to the inner portion. In another variant, each piece comprises a first portion which provides the outer sculptured face or faces and two of the three planar faces, and a second portion attached to the first portion which provides the third planar face. The dimensions of the puzzle may be somewhat larger than a typical Rubik's cube, e.g. with a largest dimension of about 100 cm and it is convenient to make each piece as a two-part moulding in thermoplastics material, the parts being assembled together by ultrasonic welding or other suitable means. Thus the first portion of the piece may be provided with sockets for receiving pegs on the second portion to form the attachment.

The internal mechanism for the puzzle may be an adaption of a known mechanisms for the parent known puzzle i.e. the 2×2×2 cube. However, from the standpoints of ease and speed of assembly, materials cost and smoothness of operation it is preferred that a version of the castellated spider mechanism should be adopted.

In those variants of the invention in which one of the pieces is fixed in position relative to and physically joined to the internal mechanism, the internal mechanism may combine (a) a portion that contains no moving parts, defines the relative position of said one piece in three axes and provides a place of attachment of said one piece, and (b) other portions that contain moving parts and provide for movement of the other pieces in three axes relative to said one piece. The fixed outer piece may be attached to the portion of the internal mechanism by one or more screws or it may be attached by gluing or sonic welding. The movable outer pieces are attached simply by inter-engaging the internal and external parts and pushing the final piece into place, so that gluing or screw fixing of the movable pieces to the internal mechanism is not required.

Thus in preferred variants of the castellated spider mechanism, the spider and the three fixed castellated members are formed as a single component. More preferably the three fixed links which also form part of that mechanism are also formed as components of the spider. The fixed piece can then be physically joined to, and not merely mechanically located relative to, the spider unit by a mechanical fastening (e.g. a screw), by sonic or other welding, or by an adhesive. With a mechanism of this kind not only is manufacturing simplicity and reduction in the parts inventory achieved, but also, unexpectedly, the action of the puzzle is smoother and manufacturing tolerances are less critical.

BRIEF DESCRIPTION OF THE DRAWINGS

How the invention may be put into effect will now be described, by way of example only with reference to the accompanying drawings, in which:

FIGS. 1 and 2 are perspective views of known 2×2×2 and 3×3×3 Rubik's cubes;

DETAILED DESCRIPTION OF THE PREFERRED EMBODIMENTS

Figure 3:
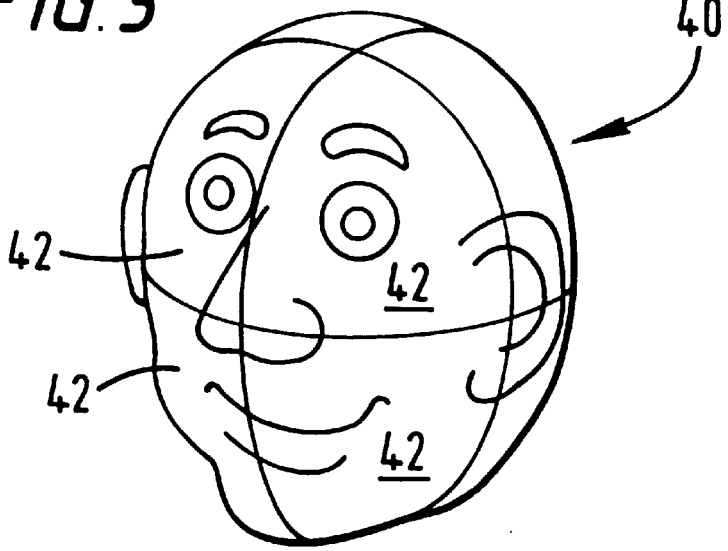
FIG. 3 is a perspective view of a first puzzle according to the invention.

In FIG. 1 there is shown a conventional 2×2×2 Rubiks cube 10 composed of pieces 11 each of which have faces 12, 14, 16 which are available to be sculpted. The cube has an internal mechanism which maintains a fixed position relative to one of the pieces 18, and permits faces of the cube containing the remaining pieces to be rotated relatively thereto about three axes as shown. By successive steps, the positions and attitudes of the remaining pieces relative to one another and to the fixed piece 18 can be changed to disorganise and reorganise the puzzle.

FIG. 2 shows a 3×3×3 cube. The internal mechanism fixes the centre piece 19, 25, 33 of each face in position but leaves them free to rotate about respective rotational axes. Each centre piece has a single exposed face. The puzzle also has side pieces e.g. the piece 31 which may be moved from one position to another by rotation of the face of the puzzle in which that piece occurs. The side pieces have two exposed faces 30,32. Corner pieces e.g. the piece 27 are also movable from one position to another by rotation of the face of the puzzle in which they occur and have exposed faces 24, 26, 28.

It is possible, according to the invention, to create a partly figurative puzzle by sculpting some only of the faces of a 2×2×2 cube, leaving the remaining faces regular and identifiable by a common colour. However, it is preferred in the case of a cubic puzzle that at least five of the six faces should be sculpted. In the variant where only five faces are sculpted, in the disorganised states of the puzzle, the non-sculpted faces which go together are immediately identifiable, which facilitates solution. The variant where all six faces are sculpted therefore offers the possibility of making the puzzle slightly more difficult.

Figure 4:
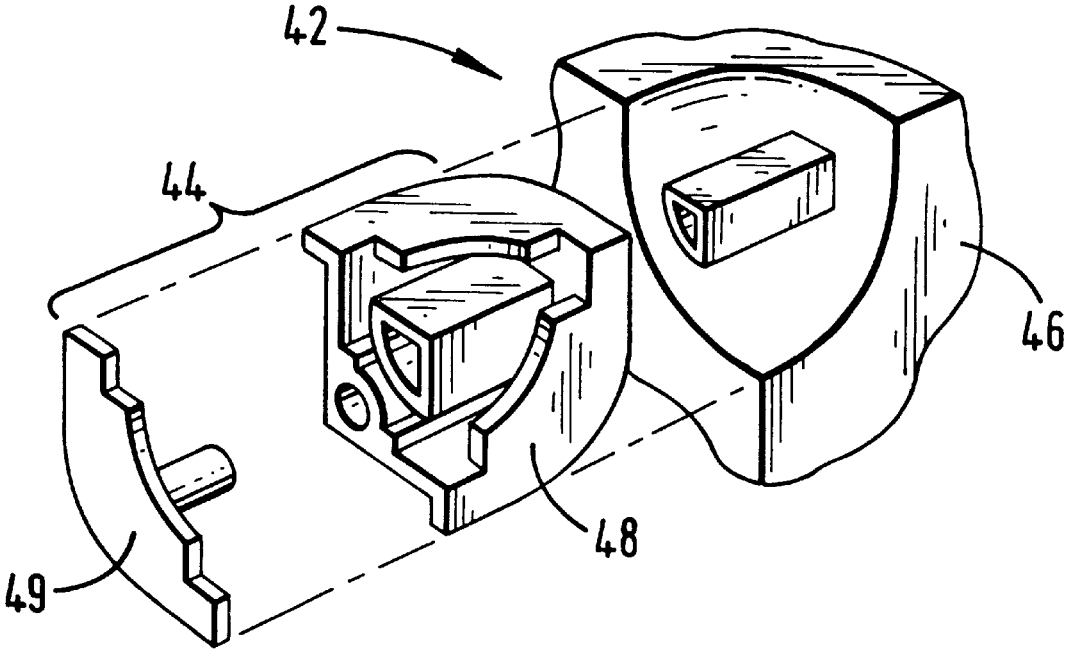
FIG. 4 is an exploded view of one of the movable pieces.

A first embodiment of the present puzzle is shown in FIGS. 3 and 4. The puzzle 40 is about 80 cm high and the eight pieces are sculpted to form an image, in this case of a human face. Each piece 42 comprises an inner portion 44 which cooperates with a conventional internal mechanism for a 2×2×2 cube (in this instance a castellated spider mechanism) and an outer portion 46 which is a push fit onto the inner portion 44 and is sculpted and decorated to form part of the image. The inner portion 44 is in two parts, with plate 49 which provides one of the three planar faces at which the pieces slide past one another attached by a peg and socket connection and by ultrasonic or other welding to body 48 which provides the other two planar faces. Instead of the outer portion 46 being a push fit onto the body 48, the outer portion 46 and body 48 can be provided with inter-engageable formations that snap fit together.

Figure 6:
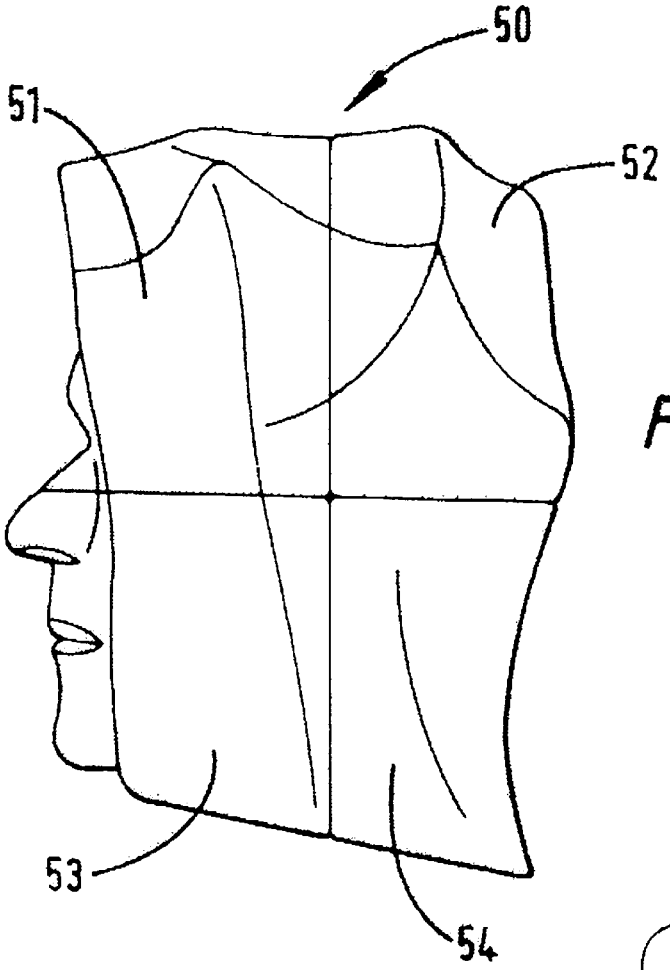
FIGS. 5 and 6 are front and side views of a second puzzle according to the invention.
Figure 5:
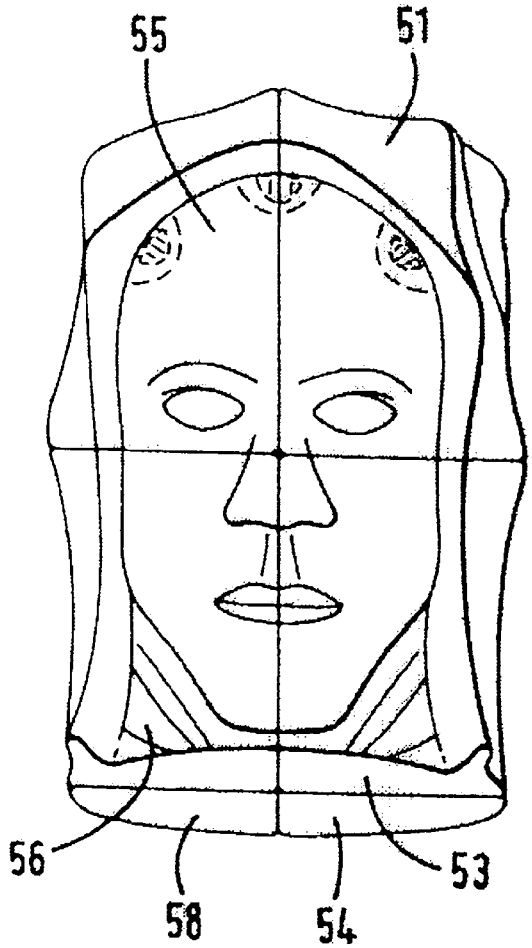
Figure 7:
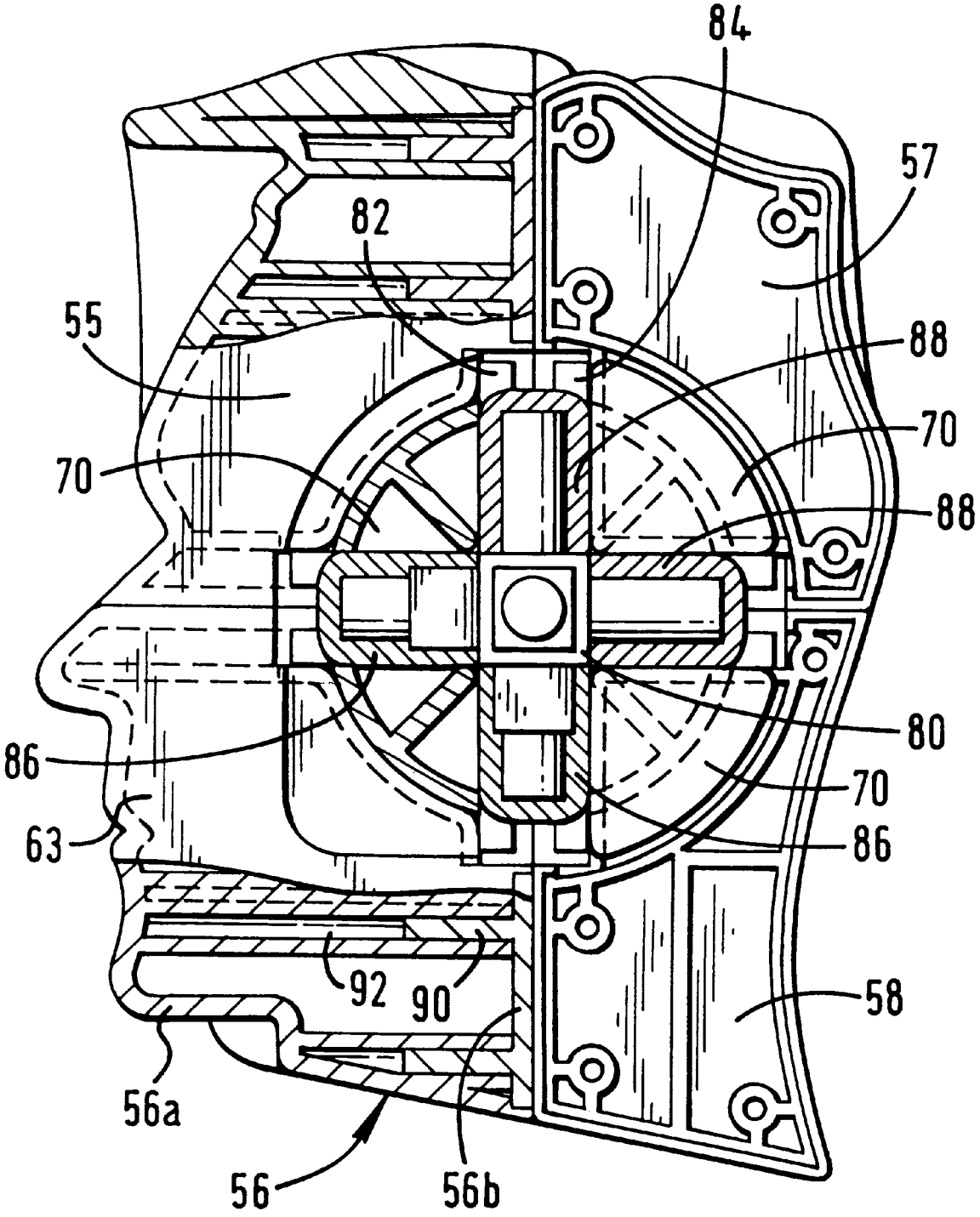
FIG. 7 is a side view of the second puzzle with one of the layers of pieces removed and with two of the pieces in the remaining layer partly sectioned, a third piece shown fully assembled and with the second portion removed from the fourth piece.
Figure 8:
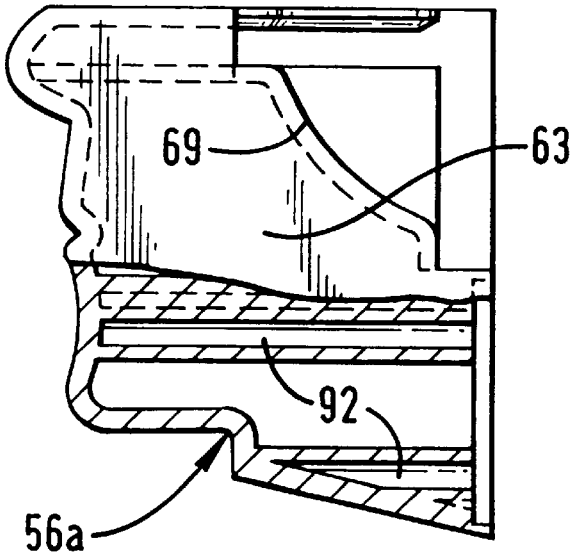
FIGS. 8–10 are respectively a partly sectioned side view, a rear elevation and a plan of a first portion of one of the pieces of the second puzzle.
Figure 9:
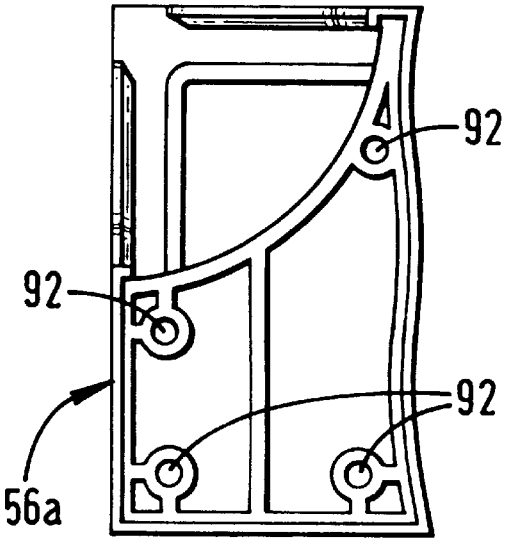
Figure 11:
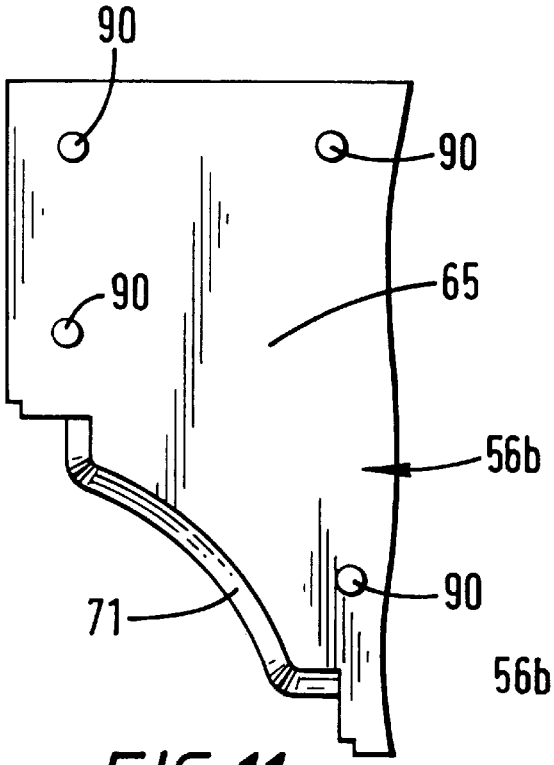
FIGS. 11–12 are respectively a plan and a side view of the second portion of the piece of FIGS. 8–10.
Figure 10:
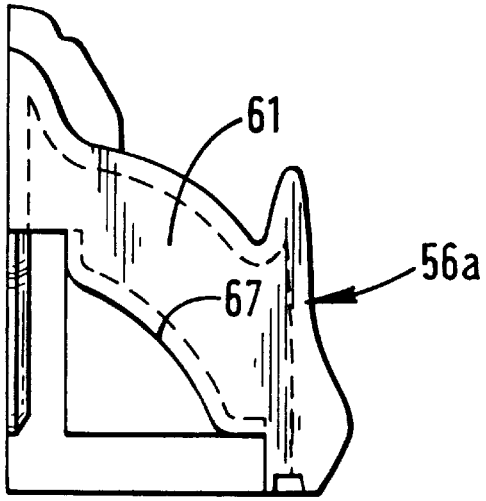
Figure 12:
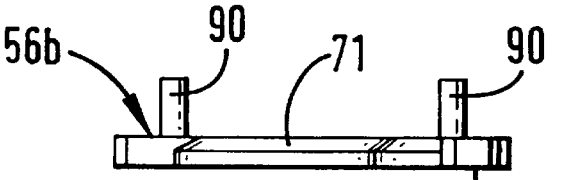

In FIGS. 5–7 there is shown a further embodiment of the puzzle in which, again, all six faces are sculpted. The maximum dimension of the pieces in each of the three orthogonal planes is different, the puzzle having a height of about 100 cm, a width of about 68 cm and a depth of about 84 cm. It is generally indicated by the reference numeral 50 and comprises pieces 53–58 connected and controlled by a 2×2×2 cube internal castellated spider mechanism generally indicated by the reference numeral 60.

It will be seen from FIGS. 8–12 that the pieces are formed in two parts. A first part 56*a* carries the outer sculptured and decorated faces and two planar inner faces 61,63. The second part 56*b* provides the third face 65 and has fixing pegs 90 which are received in sockets 92 of the first part 56*a* to hold the parts of the piece together. The internal planes of each piece advantageously meet at a small radius (e.g. about 0.75 mm) rather than at sharp edges so as to assist smooth running of the puzzle during rotation and help pieces of adjoining planes to move past one another without snagging.

Figure 13:
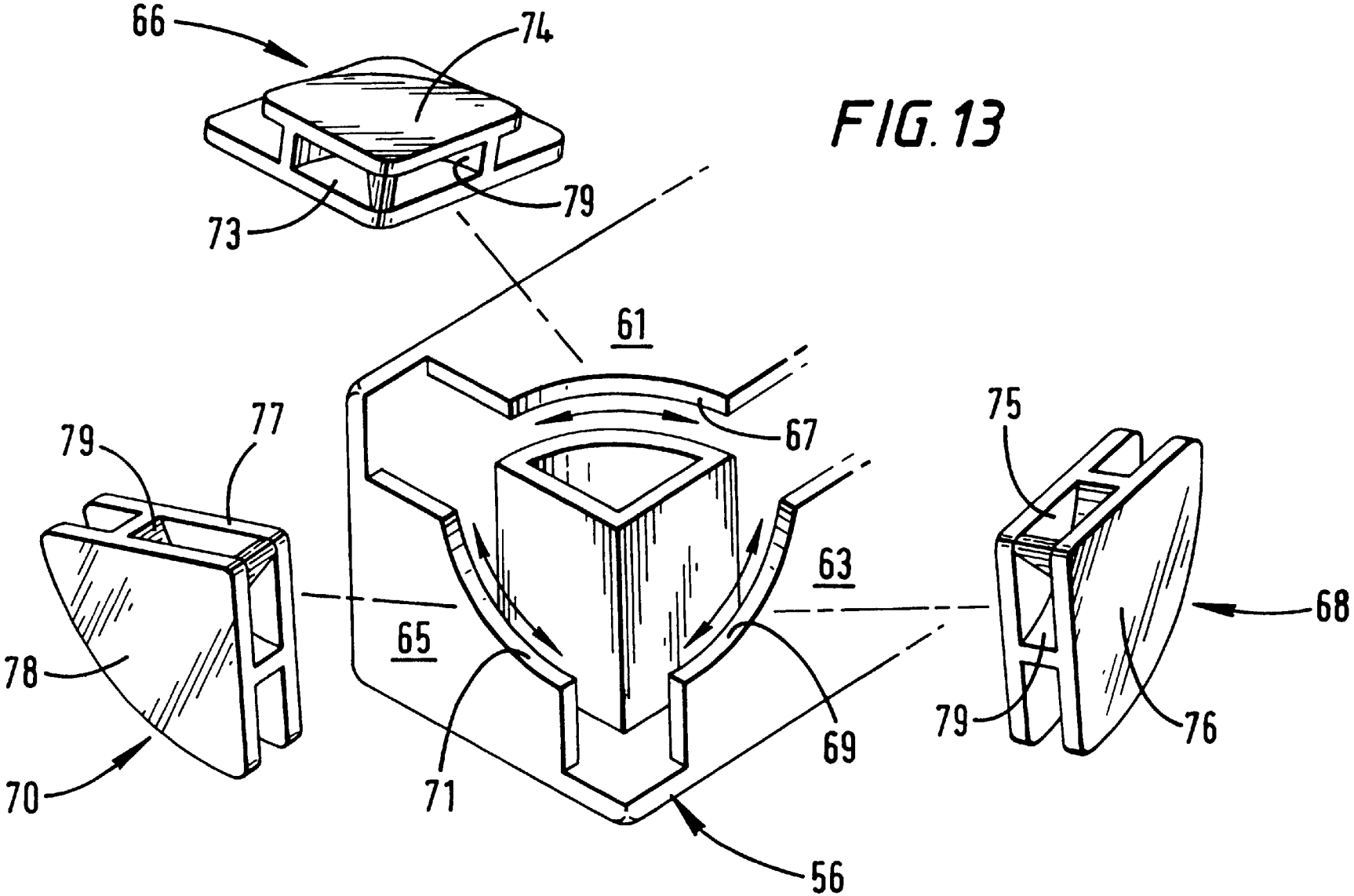
FIG. 13 is an exploded view showing diagrammatically an interior part of a piece and its associated guide members.

As is apparent from FIG. 13, a piece 56 which in this instance is to maintain a fixed position whilst the other pieces are rotatable around it comprises orthogonal walls 61,63,65 terminating in arcuate guide tracks 67,69,71 which can provide for bidirectional movement about three orthogonal axes as shown. Each piece has spaces defining three orthogonal slots behind each of the walls 61,63,65. Three links 66,68,70 connect each piece with its three adjacent pieces. Each link has a pair of spaced plates 73,74; 75,76; 77,78 which fit into adjoining slots of a pair of pieces to be connected. Between the plates of each piece, there is a wall 79 defining an arcuate surface of a quadrant which bears against a respective track 67,69,71.

The links are of two kinds. There are two links of the first kind, identified by reference numerals 66 and 68, which have one generally rectangular wall 73,75 which when fitted into the slot behind wall 61,63 holds the link in a fixed position and attitude relative to the piece 56. The arcuate plate 76,78, when fitted into the slot of the adjoining piece permits relative rotation of the piece. The remaining links 70 all have two arcuate plates 77,78 and offer no resistance to rotational movement of either of the pieces into which they are fitted.

The pieces are controlled by a central spider 80 having six arms, each of which fits between a pair of links and terminates in a castellated member, the castellations, e.g. 82,84 at the end of each member travelling through the slots of the adjacent pieces 55,57 as they are relatively rotated. Three of the arms carry castellated members 86 and three of them carry castellated members 88 which are rotatable about axes parallel to their longitudinal directions. The cube may be assembled by fitting the castellated members to the spider, and adding pieces and links until the final piece is snapped into place and holds the assembled puzzle together. This arrangement has the advantage that both the pieces and the internal components may be moulded from a single plastics material (e.g. ABS) rather than requiring a combination of different materials (e.g. ABS/nylon) to achieve the required smooth rotation. Smoothness of rotation can be achieved by a closely toleranced fit between the pieces and the internal components, the clearance between pieces being of the order of 0.05 mm and being a matter for trial and error by the puzzle designer. Furthermore, the mechanism can be assembled simply by interfitting the component parts and does not require screw assembly or gluing which are slow and labour-intensive operations.

Figure 14:
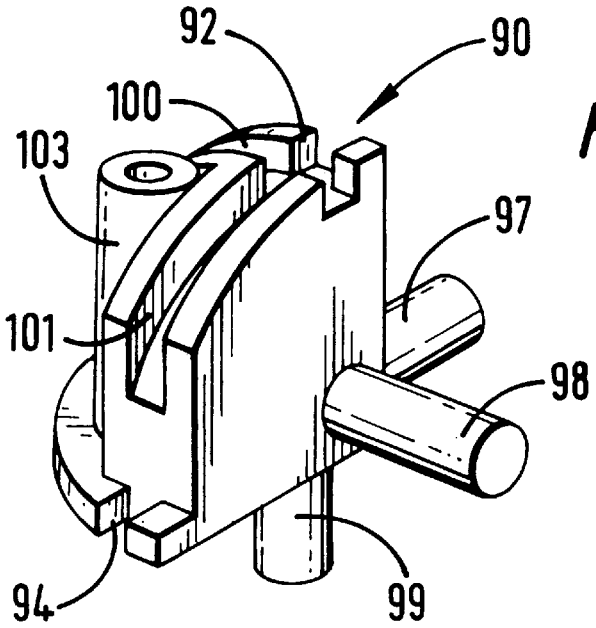
FIGS. 14–16 are perspective views of a spider unit for a second version of the puzzle of FIGS. 7–13.
Figure 15:
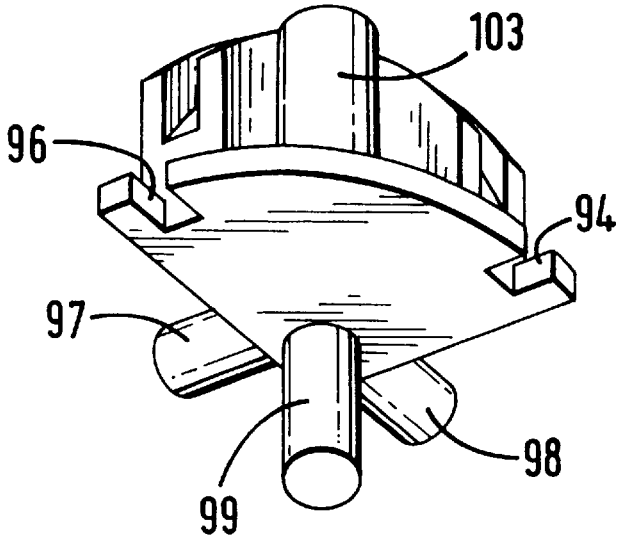
Figure 16:
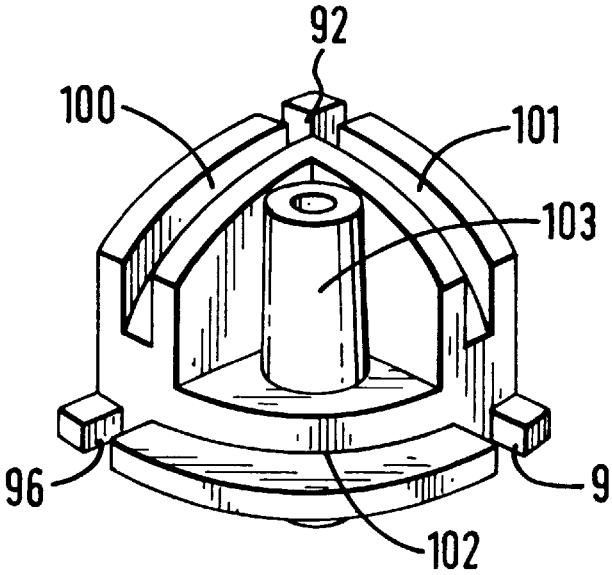

It will be appreciated that modifications may be made to the embodiments described above without departing from the invention. For example, in FIGS. 14–16 there is shown a spider unit 90 for attachment to a fixed piece (not shown). The unit 90 is a one-piece injection moulding and has fixed castellated ends 92, 94, 96 along three axes which correspond to the fixed castellations e.g. 82 of the earlier embodiment. Three arms 97, 98, 99 carry rotatable castellated members as in the earlier embodiment. Three links 100,101, 102 corresponding to three of the quadrant-shaped links in the earlier embodiment are also integrally formed in the unit 90, the link 102 only having a single plate and the remaining links having dual laterally spaced plates as before. The piece which attaches to the unit is fixed by a screw which engages into spigot 103 and has a contoured cover to hide the screw head. The second plate of link 102 is not needed because of the screw attachment of the fixed piece, and its omission facilitates moulding of the spider unit 90 by eliminating an under-cut. The fixed piece is constructed as described with reference to the previous embodiment except that there is provided a screw fixing boss and a sculptured covering cap. The screw attachment is a matter of convenience in this particular embodiment, and attachment could equally be by sonic welding or gluing. The unit 90 combines seven components from the mechanism of the previous embodiment into a single moulding, facilitates the use of wider manufacturing tolerances for the remaining components and gives the mechanism a smooth action. The remaining components of the puzzle are constructed and operate as described for the previous embodiment.

What is claimed is:

1. A manipulative puzzle comprising a body made of mechanically interconnected pieces in a 2×2×2 cube arrangement, groups of which are relatively rotatable about three axes to exchange positions of the pieces, wherein at least the height and width of the puzzle differ, and wherein the pieces have abutting planar faces which slide past one another, each of said pieces having three such planar faces arranged in a mutually orthogonal relationship and have exposed faces which are sculptured to define an image, said planar faces and exposed faces defining a closed, hollow body for said pieces, wherein each piece is of molded thermoplastics material whose thickness is small compared to the dimensions of said piece and wherein each piece comprises a first portion which provides the exposed face and two of the three planar faces, and a second portion attached to the first portion which provides the third planar face.

2. The puzzle of claim 1, wherein the largest dimensions of at least two of the planar faces of each piece differ.

3. The puzzle of claim 2, wherein the largest dimension of the three planar faces differs.

4. The puzzle of claim 1, wherein the first portion of the piece has sockets which are engaged by pegs on the second portion to form the attachment.

5. The puzzle of claim 1, wherein the pieces are held together by interlocking of internal parts of said puzzle which becomes established by pushing the final piece into place.

6. The puzzle of claim 1, wherein an internal mechanism supports groups of the pieces for relative rotation about three axes to exchange positions, and wherein one of the pieces is fixed in position relative to and physically joined to the internal mechanism.

7. The puzzle of claim 1, wherein the pieces are supported and controlled by a castellated spider mechanism.

8. The puzzle of claim 7, wherein the mechanism includes as an integrally formed component at least the spider and the three fixed castellated members.

9. The puzzle of claim 8, wherein the castellated spider mechanism includes linking members that fit between the arms of the spider and slidably engage adjacent pieces, and the integrally formed component further comprises three of the linking members.

10. A manipulative puzzle as claimed in claim 1, having five sculpted faces and one planar face.

11. The puzzle of claim 1, wherein the image is of a head.

12. A piece for the manipulative puzzle of claim 1 which is a hollow body and comprises:

a region which becomes located within the interior of the puzzle and is provided with means for mechanical engagement with an internal mechanism of said puzzle to establish a pivotal connection to said mechanism;

three closed planar faces arranged in a mutually orthogonal relationship for slidable abutment with adjoining faces of other pieces, the largest dimensions of at least two of the planar faces differing; and three exposed faces, at least one of which is sculpted to define part of an images wherein said piece is of molded thermoplastics material whose thickness is small compared to the dimensions of said piece and wherein said piece further comprises a first portion which provides the exposed faces and two of the three planar faces, and a second portion attached to the first portion which provides the third planar face.

13. The piece of claim 12, wherein the largest dimension of the three planar faces differs.

14. The piece of claim 12, wherein the first portion has sockets which are engaged by pegs on the second portion to form the attachment.

* * * * *